US011484851B2

(12) United States Patent
Ishihata

(10) Patent No.: US 11,484,851 B2
(45) Date of Patent: Nov. 1, 2022

(54) PARALLEL STIRRING BLADE

(71) Applicant: Sanko Astec Inc., Tokyo (JP)

(72) Inventor: Atsuhiro Ishihata, Tokyo (JP)

(73) Assignee: SANKO ASTEC INC., Tokyo (JP)

( * ) Notice: Subject to any disclaimer, the term of this patent is extended or adjusted under 35 U.S.C. 154(b) by 331 days.

(21) Appl. No.: 16/349,147

(22) PCT Filed: Dec. 6, 2017

(86) PCT No.: PCT/JP2017/043768
§ 371 (c)(1),
(2) Date: May 10, 2019

(87) PCT Pub. No.: WO2018/131339
PCT Pub. Date: Jul. 19, 2018

(65) Prior Publication Data

US 2019/0270058 A1 Sep. 5, 2019

(30) Foreign Application Priority Data

Jan. 11, 2017 (JP) ..... JP2017-002286

(51) Int. Cl.
*B22C 5/00* (2006.01)
*B01F 27/90* (2022.01)
(Continued)

(52) U.S. Cl.
CPC ..... *B01F 27/90* (2022.01); *B01F 27/074* (2022.01); *B01F 27/191* (2022.01)

(58) Field of Classification Search
CPC ..... B01F 7/18; B01F 7/00191; B01F 7/00633
See application file for complete search history.

(56) References Cited

U.S. PATENT DOCUMENTS 2,655,354 A 10/1953 Murray
3,914,956 A 10/1975 Knight, Jr.
(Continued)

FOREIGN PATENT DOCUMENTS

CN 202983578 U 6/2013
CN 203108478 U 8/2013
(Continued)

OTHER PUBLICATIONS

Google machine translation of "CN-104624098-A" (Year: 2015).*
(Continued)

*Primary Examiner* — Anshu Bhatia
*Assistant Examiner* — Gregory Y Huan
(74) *Attorney, Agent, or Firm* — Flynn Thiel, P.C.

(57) ABSTRACT

A stirring blade includes a first member having a first flat surface and a second member having a second flat surface, wherein the stirring blade is rotatable about a rotational axis in a state where the first and second flat surfaces are opposed to each other and spaced by a first distance across the rotational axis. When the stirring blade is rotated about the rotational axis with the first and second flat surfaces at least partially immersed in an object to be stirred, the object to be stirred having entered between the first and second flat surfaces is discharged in a direction away from the rotational axis by a centrifugal force and, simultaneously, the object to be stirred is sucked into and between the first and second flat surfaces from a direction along the rotational axis.

1 Claim, 6 Drawing Sheets

(51) Int. Cl.
*B01F 27/07* (2022.01)
*B01F 27/191* (2022.01)

(56) References Cited

U.S. PATENT DOCUMENTS

| | | | | |
|---|---|---|---|---|
| 4,312,596 | A | 1/1982 | Maezawa et al. | |
| 7,258,479 | B1 | 8/2007 | Westby | |
| 2003/0004377 | A1 | 1/2003 | Inaoka et al. | |
| 2003/0067836 | A1 | 4/2003 | Clifford Fink, Jr. | |
| 2004/0085856 | A1 * | 5/2004 | Murosako | B01F 7/0045 366/262 |
| 2007/0064523 | A1 | 3/2007 | Wilson | |
| 2007/0140053 | A1 | 6/2007 | Jejcic | |
| 2007/0152357 | A1 | 7/2007 | Matsumoto | |
| 2009/0219780 | A1 | 9/2009 | Castillo et al. | |
| 2009/0299027 | A1 | 12/2009 | Kurose et al. | |
| 2010/0202247 | A1 | 8/2010 | Pan | |
| 2011/0027144 | A1 | 2/2011 | Shibata et al. | |

FOREIGN PATENT DOCUMENTS

| | | | | | |
|---|---|---|---|---|---|
| CN | 104624098 | A | * | 5/2015 | |
| CN | 104624098 | A | | 5/2015 | |
| CN | 204338049 | U | | 5/2015 | |
| CN | 205683894 | U | | 11/2016 | |
| DE | 4134025 | A1 | | 4/1993 | |
| FR | 2385439 | A1 | | 10/1978 | |
| GB | 794963 | | | 5/1958 | |
| JP | 3924483 | | | 8/1939 | |
| JP | 57-9328 | U | | 1/1982 | |
| JP | 5916530 | A | | 1/1984 | |
| JP | S5916530 | B2 | * | 4/1984 | |
| JP | 61143401 | A | | 7/1986 | |
| JP | 6219300 | U | | 2/1987 | |
| JP | 03-38135 | U | | 4/1991 | |
| JP | H0338135 | U | * | 4/1991 | |
| JP | 4235727 | A | | 8/1992 | |
| JP | 6134274 | A | | 5/1994 | |
| JP | 06-170202 | A | | 6/1994 | |
| JP | 07-34928 | U | | 6/1995 | |
| JP | 10-128092 | A | | 5/1998 | |
| JP | 2002273188 | A | | 9/2002 | |
| JP | 2005-296894 | A | | 10/2005 | |
| JP | 2006110472 | A | | 4/2006 | |
| JP | 2006176874 | A | | 7/2006 | |
| JP | 2007-083223 | A | | 4/2007 | |
| JP | 201042377 | A | | 2/2010 | |
| JP | 201046635 | A | | 3/2010 | |
| JP | 201058027 | A | | 3/2010 | |
| JP | 3158760 | U | | 4/2010 | |
| JP | 2010270556 | A | | 12/2010 | |
| JP | 2011-206631 | A | | 10/2011 | |
| JP | 201359723 | A | | 4/2013 | |
| KR | 1020090124951 | A | | 12/2009 | |
| TW | 200922686 | A | * | 6/2009 | B01F 15/00831 |
| WO | 8906160 | A1 | | 7/1989 | |
| WO | 2011/122370 | A1 | | 10/2011 | |

OTHER PUBLICATIONS

Google machine translation for "TW200922686A" (Year: 2009).*
Japanese Forms PCT/ISA/210, PCT/ISA/220 and PCT/ISA/237 for corresponding PCT/JP2017/043768 (11 pages).
English International Search Report for corresponding PCT/JP2017/043768 (2 pages).
Korean Office Action issued in corresponding Korean Application No. 10-2019-7014065, dated Sep. 28, 2020 (8 pages).
Chinese Office Action issued in corresponding Chinese Application No. 201780082697.3 dated Mar. 30, 2021 (10 pages).
European Search Report issued in corresponding European Application No. 17891601.1, dated Sep. 16, 2020 (13 pages).
Notice of Reasons for Refusal issued in corresponding Japanese Patent Application No. 2017-002286, with English translation, dated Feb. 21, 2017 (8 pages).
Notice of Reasons for Refusal issued in corresponding Japanese Patent Application No. 2017-002286, with English translation, dated Mar. 30, 2017 (10 pages).
International Preliminary Report on Patentability issued in International Application No. PCT/JP2017/043768, dated Jul. 16, 2019 (1 page).
English Translation of Written Opinion of the International Searching Authority issued in International Application No. PCT/JP2017/043768, dated Feb. 20, 2018 (10 pages).
Notification to Grant Patent Right for Invention with partial English translation issued in corresponding Chinese Patent Application No. 201780082697.3, dated Aug. 9, 2021 (7 pages).

* cited by examiner (b)

(a)

PARALLEL STIRRING BLADE

TECHNICAL FIELD

The present invention relates to stirring blades and stirring apparatuses, in particular, an efficient stirring blade having a simple structure with two facing flat surfaces, and a stirring apparatus having such a stirring blade.

BACKGROUND ART

For the shape of conventional stirring blades, there are various types, in general, a propeller type, a paddle type, a turbine type, a cone type and others. FIG. 9 shows one example of a stirring apparatus 1 having a conventional paddle blade 3. Further, Patent Literature 1 discloses a stirring apparatus having conventional rotational paddles as a stirring blade. However, since conventional stirring blades have relatively complicated shapes, their production costs are high and washing thereof often requires care. Thus, there is a need for a stirring blade with a simple structure that can be produced at a lower cost.

Further, conventional stirring blades are designed for rotation at comparatively high speeds (for example, about 250 to 1000 revolutions per minute). Thus, in the field of biopharmaceutical products, for example, there is a drawback that shearing or destruction is likely to occur in biomaterials such as microorganisms or cells of living organisms as the object to be stirred. Thus, there is a need for a stirring blade that is capable of stirring biomaterials such as microorganisms or cells of living organisms gently while shearing or destruction of the above materials is kept at the minimum level.

Further, since conventional stirring blades have a smaller dimension in a lengthwise direction (direction of a rotational axis), a change of liquid level causes stirring blades to readily appear above the surface of a liquid, disadvantageously resulting in insufficient stirring. Hence, there is a need for a stirring blade capable of handling liquid level changes.

CITATION LIST

Patent Literature

Patent Literature 1: JP-A 6-170202

SUMMARY OF INVENTION

Technical Problem

One object of the present invention is to provide a stirring blade that can be produced at a low cost and has a simple structure. One object of the present invention is to provide a stirring blade that stirs gently biomaterials such as microorganisms or cells of living organisms as objects to be stirred while keeping shearing or destruction thereof at the minimum level. One object of the present invention is to provide a stirring blade that can handle liquid level changes. Other objects of the present invention will be clear from the following detailed description.

Solution to Problem

In one embodiment, the present invention provides a stirring blade that includes a first member having a first flat surface and a second member having a second flat surface, wherein the stirring blade is rotatable about a rotational axis in a state where the first flat surface and the second flat surface are opposed to each other and spaced by a first distance across the rotational axis.

In another embodiment, the present invention provides a stirring apparatus that includes the stirring blade and a rotational driving device that rotates the first and second flat surfaces about the rotational axis.

In another embodiment, the present invention provides a method for stirring an object to be stirred, which includes: at least partially immersing, in the object to be stirred, the first and second flat surfaces that are kept in such a state as to oppose each other and be spaced by a first distance across a rotational axis; and rotating the first and second flat surfaces about the rotational axis.

BRIEF DESCRIPTION OF DRAWINGS

FIG. 1(*b*) is an exploded perspective view of a stirring blade 11 of the stirring apparatus 10 shown in FIG. 1(*a*). FIG. 1(*c*) is a front view of the stirring blade 11.

FIG. 3(*b*) is a drawing showing another example of a holding member for holding the stirring blade at a desired height in the container.

FIG. 6(*b*) is an exploded perspective view of the stirring blade 31 of the stirring apparatus 30 shown in FIG. 6(*a*).

FIG. 7(*b*) is a cross-sectional view taken along line K-K' of the stirring blade 31 of FIG. 7(*a*).

DESCRIPTION OF EMBODIMENTS

Figure 1:
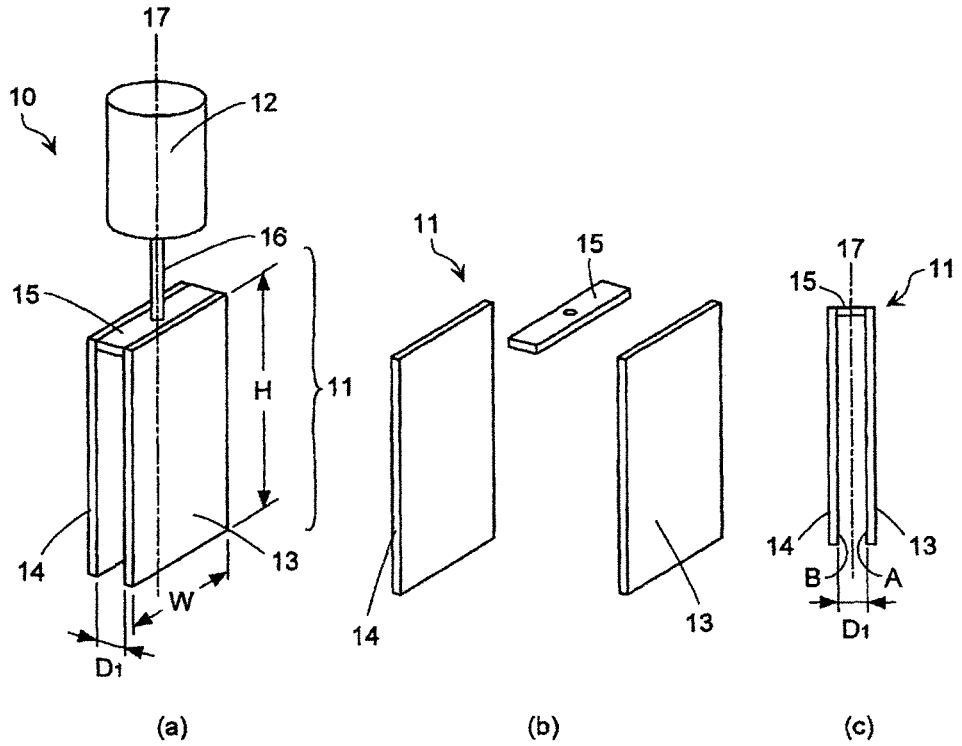
FIG. 1(*a*) is a perspective view showing a stirring apparatus 10 according to one embodiment of the present invention.

In one embodiment, the present invention provides a stirring blade, which includes a first member having a first flat surface and a second member having a second flat surface, wherein the stirring blade is rotatable about a rotational axis in a state where the first flat surface and the second flat surface are opposed to each other and spaced by a first distance across the rotational axis.

The first and second flat surfaces may have the same shape. The first and second flat surfaces may have different shapes. The first and second flat surfaces may have the same height in a direction of the rotational axis. The first and second flat surfaces may have different heights in the direction of the rotational axis. The first and second flat surfaces may have the same width in a direction orthogonal to the rotational axis. The first and second flat surfaces may have different widths in the direction orthogonal to the rotational axis. The first and second flat surfaces each may have a rectangular shape. The first and second flat surfaces each may have a trapezoidal shape (including both of one with a shorter upper side and one with a shorter lower side), a circular shape, an oval shape or a rhombic shape.

The stirring blade may further include a support member. The first and second members may be coupled to the support member. The first and second flat surfaces may be kept in such a state as to oppose each other and be spaced by a first distance across the rotational axis. At least some of the first member, the second member and the support member may be formed integrally. The space between the first flat surface of the first member and the second flat surface of the second member may be open in a width direction of the first member and the second member. The space between the first flat surface of the first member and the second flat surface of the second member may further be open in a direction along the rotational axis.

The first and second members may each be a plate-like member. The first and second members may each be a rectangular plate-like member. The first and second members may each be a plate-like member having a trapezoidal shape (including both of one with a shorter upper side and one with a shorter lower side), a circular shape, an oval shape or a rhombic shape. The first and second members may each be a semi-spherical member. The support member may be a plate-like member. The support member may be a plate-like member having one or more openings. The support member may be an H-shaped frame member.

The first member, the second member and the support member may each be formed of a metal such as aluminum or stainless steel. The first member, the second member and the support member may each be formed of a resin such as plastics or acryl. At least some of the first member, the second member and the support member may be formed separately from other member and coupled to the other member by welding or an adhesive. At least some of the first member, the second member and the support member may be formed integrally by bending of a single plate-like material. At least some of the first member, the second member and the support member may be formed integrally by molding such as injection molding or extrusion molding.

The rotational axis may be disposed between the first and second flat surfaces. The rotational axis may be disposed between the first and second flat surfaces so as to be equidistant from the first and second flat surfaces.

When the first and second flat surfaces are at least partially immersed in the object to be stirred and rotated about the rotational axis, the object to be stirred having entered between the first and second flat surfaces is discharged in a direction away from the rotational axis by a centrifugal force and, simultaneously, the object to be stirred is sucked into and between the first and second flat surfaces from the direction along the rotational axis.

The object to be stirred may include a plurality of different kinds of liquids. The object to be stirred may include a liquid coating and a thinner. The object to be stirred may include different kinds of medical fluids. The object to be stirred may include a liquid, and a solid such as granules or powder. The solid such as granules or powder may be a solid soluble in a liquid. The solid such as granules or powder may be a solid insoluble in a liquid. The object to be stirred may include sugar or salt, and water. The object to be stirred may include an aqueous solution such as a bleaching agent, and pulp. The object to be stirred may include a chemical solution such as a culture solution or a reagent, and a biomaterial such as microorganisms or cells of a living organism.

The first and second flat surfaces may be immersed in the object to be stirred in such a manner that the rotational axis is vertical to a liquid surface of the object to be stirred. The first and second flat surfaces may be immersed in the object to be stirred in such a manner that the rotational axis is tilted from a vertical line relative to the liquid surface of the object to be stirred.

The first and second flat surfaces may be rotated at a rotational speed of 10 rpm (revolutions per minute) or more, preferably 30 rpm or more, and further preferably 50 rpm or more. The first and second flat surfaces may be rotated at a rotational speed of 200 rpm or less, preferably 150 rpm or less, and further preferably 100 rpm or less. In one example, the first and second flat surfaces may be rotated at a rotational speed of 10 rpm or more and 200 rpm or less.

The first and second flat surfaces may each have a long and narrow shape extending in the direction of the rotational axis.

The first and second flat surfaces may further each have a paddle blade on a surface outside a radius of rotation. The paddle blade may be formed of a metal such as aluminum or stainless steel. The paddle blade may be formed of a resin such as plastics or acryl. The paddle blade may be separately from the first member or the second member, and coupled thereto by welding or an adhesive. The paddle blade may be formed integrally with the first member or the second member by molding such as injection molding or extrusion molding.

The first member may further have a third flat surface and a fourth flat surface vertical to the first flat surface. The third and fourth flat surfaces may be disposed so as to oppose each other and be spaced by a second distance. The space between the third and fourth flat surfaces may be open in a direction vertical to the first flat surface. The space between the third and fourth flat surfaces may further be open in a direction along the rotational axis. The second member may have a fifth flat surface and a sixth flat surface vertical to the second flat surface. The fifth and sixth flat surfaces may be disposed so as to oppose each other and be spaced by the second distance. The space between the fifth and sixth flat surfaces may be open in a direction vertical to the second flat surface. The space between the fifth and sixth flat surfaces may further be open in a direction along the rotational axis. The first and second distances may be equal to each other. The first and second distances may be different from each other.

The third and fifth flat surfaces may be disposed on a first virtual flat surface. The fourth and sixth flat surfaces may be disposed on a second virtual flat surface. The rotational axis may be disposed between the first and second virtual flat surfaces. The rotational axis may be disposed between the first and second virtual flat surfaces so as to be equidistant from the first and second virtual flat surfaces.

In other embodiment, the present invention provides a stirring apparatus, which includes a stirring blade configured as described above according to the present invention, and a rotational driving device for rotating the first and second flat surfaces about the rotational axis. The support member may be coupled to the rotational driving device via a shaft.

The rotational driving device may include a motor. The rotational driving device may include a motor and a speed reducer.

The stirring apparatus may further include a container for containing an object to be stirred, and a holding member for holding the stirring blade at a desired height in the container.

The holding member may include a lid of the container, and a fixture for coupling a flange of the rotational driving device to the periphery of an opening of the lid of the container. The fixture may include a bolt and a nut, and others. The holding member may include a first magnet placed on the bottom of the container, and a first shaft that is coupled to the first magnet and the stirring blade and holds the stirring blade at a desired height in the container. The first magnet may be coupled across a bottom of the container to a second magnet with an opposite polarity placed outside the container by a magnetic force, and rotated by the rotational driving device through the second magnet and a second shaft.

The container may have a cylindrical shape. The container may have a shape of a regular polygonal column such as a regular hexagonal column or a regular octagonal column. The container may be formed of a metal such as aluminum or stainless steel. The container may be formed of a resin such as plastics or acryl.

As one example, the container may, for example, have a cylindrical shape with a diameter and a depth; and the first and second flat surfaces may have the same rectangular shape, the same height in the direction of the rotational axis, and the same width in the direction orthogonal to the rotational axis.

(i) In this case, the width of the first and second flat surfaces is 20% or more, preferably 25% or more, or more preferably 30% or more of the diameter of the container. Further, the width of the first and second flat surfaces is 80% or less, preferably 75% or less, or more preferably 70% or less of the diameter of the container. For example, the width of the first and second flat surfaces may be 20% or more and 80% or less of the diameter of the container.

(ii) In this case, the height of the first and second flat surfaces is 20% or more, preferably 25% or more, or more preferably 30% or more of the depth of the container. Further, the height of the first and second flat surfaces is 80% or less, preferably 75% or less, or more preferably 70% or less of the depth of the container. For example, the height of the first and second flat surfaces may be 20% or more and 80% or less of the depth of the container.

(iii) In this case, the first distance between the first and second flat surfaces is 20% or more, preferably 25% or more, or more preferably 30% or more of the width of the first and second flat surfaces. Further, the first distance between the first and second flat surfaces is 80% or less, preferably 75% or less, or more preferably 70% or less of the width of the first and second flat surfaces. For example, the first distance between the first and second flat surfaces may be 20% or more and 80% or less of the width of the first and second flat surfaces.

As another example, the container may, for example, have a regular square columnar shape having a square horizontal cross section and a depth; and the first and second flat surfaces may have the same rectangular shape, the same height in the direction of the rotational axis, and the same width in the direction orthogonal to the rotational axis.

(i) In this case, the width of the first and second flat surfaces is 20% or more, preferably 25% or more, or more preferably 30% or more of a length of one side of the square horizontal cross section of the container. Further, the width of the first and second flat surfaces is 80% or less, preferably 75% or less, or more preferably 70% or less of the length of one side of the square horizontal cross section of the container. For example, the width of the first and second flat surfaces may be 20% or more and 80% or less of the length of one side of the square horizontal cross section of the container.

(ii) In this case, the height of the first and second flat surfaces is 20% or more, preferably 25% or more, or more preferably 30% or more of the depth of the container. Further, the height of the first and second flat surfaces is 80% or less, preferably 75% or less, or more preferably 70% or less of the depth of the container. For example, the height of the first and second flat surfaces may be 20% or more and 80% or less of the depth of the container.

(iii) In this case, the first distance between the first and second flat surfaces is 20% or more, preferably 25% or more, or more preferably 30% or more of the width of the first and second flat surfaces. Further, the first distance between the first and second flat surfaces is 80% or less, preferably 75% or less, or more preferably 70% or less of the width of the first and second flat surfaces. For example, the first distance between the first and second flat surfaces may be 20% or more and 80% or less of the width of the first and second flat surfaces.

In another embodiment, the present invention provides a method for stirring an object to be stirred. This method includes: at least partially immersing, in the object to be stirred, the first and second flat surfaces that are kept in such a state as to oppose each other and be spaced by a first distance across a rotational axis; and rotating the first and second flat surfaces about the rotational axis.

In the method, the rotating the first and second flat surfaces may further include: discharging the object to be stirred having entered between the first and second flat surfaces in a direction away from the rotational axis by a centrifugal force and, simultaneously, sucking the object to be stirred into and between the first and second flat surfaces from a direction along the rotational axis.

In the method, the first and second flat surfaces may be rotated at a rotational speed of 10 rpm or more and 200 rpm or less.

Next, with reference to the drawings, embodiments of the present invention will be described in further detail.

FIG. 1(*a*) is a perspective view showing a stirring apparatus 10 having a stirring blade 11 according to one embodiment of the present invention. The stirring apparatus 10 includes the stirring blade 11 for stirring an object to be stirred, and a rotational driving device 12 for rotating the stirring blade 11. FIG. 1(*b*) is an exploded perspective view of the stirring blade 11; and FIG. 1(*c*) is a front view of the stirring blade 11. The stirring blade 11 includes a first member 13 having a first flat surface A and a second member 14 having a second flat surface B. The stirring blade 11 further includes a support member 15. The first and second members 13 and 14 are coupled to the support member 15, and the first and second flat surfaces A and B are kept by the support member 15 in such a state where they are opposed to each other and spaced by a first distance $D_1$ across a rotational axis 17. However, as described below, at least some of the first member 13, the second member 14 and the support member 15 may be integrally formed. As shown in FIG. 1(*a*), the support member 15 is coupled to the rotational driving device 12 through a shaft 16. The first and second flat surfaces A and B are rotated by the rotational driving device 12 about the rotational axis 17. As shown in FIG. 1(*a*) and FIG. 1(*c*), the space between the first flat surface A of the first member 13 and the second flat surface B of the second member 14 is open in a width (W) direction of the first member 13 and the second member 14. Further, the space between the first flat surface A of the first member 13 and the second flat surface B of the second member 14 is open also in a direction along the rotational axis 17 (downward direction in the illustrated example).

The first and second members 13 and 14 may have any shape as long as they have a flat surface A and a flat surface B, respectively. In one embodiment, the first and second members 13 and 14 are each a plate-like member. In one embodiment, the first and second members 13 and 14 are each a rectangular plate-like member. In one embodiment, the first and second members 13 and 14 are each a plate-like member having a trapezoidal shape (including both of one with a shorter upper side and one with a shorter lower side), a circular shape, an oval shape or a rhombic shape. In one embodiment, the first and second members 13 and 14 are each a semi-spherical member.

The support member 15 may have any shape as long as it can keep a state where the first flat surface A of the first member 13 and the second flat surface B of the second member 14 are opposed to each other and spaced by a first distance $D_1$ across a rotational axis 17. In one embodiment, the support member 15 is a plate-like member as shown in FIG. 1(*a*). In one embodiment, the support member 15 is a plate-like member having one or more openings for enabling an easy vertical flow of an object to be stirred. In one embodiment, the support member 15 is an H-shaped frame member.

The first flat surface A of the first member 13 and the second flat surface B of the second member 14 may have various shapes, various heights H in the direction of the rotational axis, and various widths W in the direction orthogonal to the rotational axis within such a range that effects of the invention can be produced. In one embodiment, the first and second flat surfaces A and B have the same shape. In one embodiment, the first and second flat surfaces A and B have a different shape. In one embodiment, the first and second flat surfaces A and B have the same height H in the direction of the rotational axis 17. In one embodiment, the first and second flat surfaces A and B have a different height in the direction of the rotational axis 17. In one embodiment, the first and second flat surfaces A and B have the same width W in the direction orthogonal to the rotational axis 17. In one embodiment, the first and second flat surfaces A and B have a different width in the direction orthogonal to the rotational axis 17. In one embodiment, the first and second flat surfaces A and B each have a rectangular shape. In one embodiment, the first and second flat surfaces A and B each have a trapezoidal shape (including one with a shorter upper side and one with a shorter lower side both), a circular shape, an oval shape or a rhombic shape.

Each of the first member 13, the second member 14 and the support member 15 may be formed of any material within such a range that effects of the invention can be produced. In one embodiment, the first member 13, the second member 14 and the support member 15 are each formed of a metal such as aluminum or stainless steel. In one embodiment, the first member 13, the second member 14 and the support member 15 are each formed of a resin such as plastics or acryl. In one embodiment, at least some of the first member 13, the second member 14 and the support member 15 may be separately from other member and coupled to the other member by welding or an adhesive. In one embodiment, at least some of the first member 13, the second member 14 and the support member 15 may be formed integrally by bending of a single plate-like material. In one embodiment, at least some of the first member 13, the second member 14 and the support member 15 may be formed integrally by molding such as injection molding or extrusion molding.

In one embodiment, the rotational axis 17 is disposed between the first and second flat surfaces A and B. In one embodiment, the rotational axis 17 is disposed between the first and second flat surfaces A and B so as to be equidistant from the first and second flat surfaces A and B. In one embodiment, the first and second members 13 and 14 have the same width W and the rotational axis 17 is disposed so as to be equidistant from both edges in the width (W) direction of the first and second members 13 and 14. However, the position of the rotational axis 17 may not always be at the geometrical center; and it may be slightly displaced from the geometrical center within such a range that effects of the invention can be produced.

Figure 2:
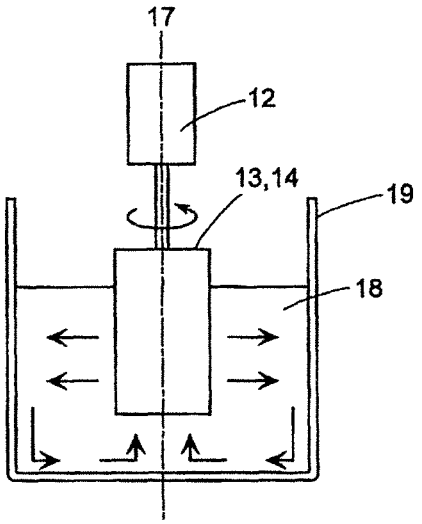
FIG. 2 is a drawing wherein arrows indicate a convection current generated in an object to be stirred when the stirring blade according to one embodiment of the present invention is immersed in the object to be stirred and rotated.

FIG. 2 is a drawing wherein a convection current generated in an object 18 to be stirred is indicated by arrows when the stirring blade 11 shown in FIG. 1 is immersed and rotated in the object 18 to be stirred. When the first flat surface A of the first member 13 and the second flat surface B of the second member 14 are at least partially immersed in the object 18 to be stirred and they are rotated about the rotational axis 17, the object 18 to be stirred having entered between the first and second flat surfaces A and B is discharged in a direction away from the rotational axis 17 as indicated by arrows by means of a centrifugal force and, simultaneously, the object 18 to be stirred is sucked into and between the first and second flat surfaces A and B from the direction along the rotational axis 17 (downward direction in the embodiment of FIG. 2). As a result, a convection current is generated in the object 18 to be stirred, so that the object 18 to be stirred is stirred.

In one embodiment, the stirring blade 11 is immersed in the object 18 to be stirred in such a manner that the rotational axis 17 is vertical relative to the surface of a liquid as shown in FIG. 2. Note that the stirring blade 11 need not always be immersed in a vertical manner to the surface of a liquid. In some embodiments, the stirring blade 11 may be immersed in the object 18 to be stirred in such a manner that the rotational axis 17 is inclined (not illustrated) from the vertical position relative to the surface of a liquid within such a range that effects of the invention can be produced. The immersing with such inclination may be useful when it is desired to generate a turbulent flow in the object 18 to be stirred.

The stirring blade of the present invention is usable in various fields including biotechnology, pharmaceuticals, foods, chemistry, architecture, paper manufacturing, mining and others. In one embodiment, the object 18 to be stirred includes a plurality of different kinds of liquids. For example, in the field of architecture, the object 18 to be stirred is not limited, but may include different kinds of liquids such as a liquid coating and a thinner. For example, in the field of pharmaceuticals, the object 18 to be stirred is not limited, but may include different kinds of medical fluids. In one embodiment, the object 18 to be stirred includes a liquid, and a solid such as granules or powders. The solid such as granules or powders may include both those soluble in a liquid and those insoluble in a liquid. For example, in the field of foods, the object 18 to be stirred is not limited, but may include a water-soluble powder such as sugar or salt, and water. For example, in the field of paper manufacturing, the object 18 to be stirred is not limited, but may include an aqueous solution such as a bleaching agent, and pulp. For example, in the field of biotechnology, the object 18 to be stirred is not limited, but may include chemical solutions such as a culture solution or a reagent, and biomaterials such as microorganisms or cells of living organisms.

The first and second flat surfaces A and B are rotated, for the obtainment of an effective stirring ability, at a rotational speed of 10 rpm (revolutions per minute) or more, preferably 30 rpm or more, or further preferably 50 rpm. Further, the first flat surfaces A and B are rotated, in order to gently stir the object to be stirred, at a rotational speed of 200 rpm or less, preferably 150 rpm or less, or further preferably 100 rpm or less.

The rotational driving device 12 is composed of a motor (not illustrated), a speed reducer (not illustrated) and others. Since the stirring blade 11 of the present invention has a lower rotational speed of the stirring plates (i.e., the first member 13 and the second member 14), it allows the speed reducer to have a higher speed reducing ratio, therefore enabling the stirring plate to rotate with a high torque. Note that when a motor with a high torque at a low rotational speed is available, a speed reducer may be omitted.

In one embodiment, the stirring apparatus 10 further includes a container 19 for containing the object 18 to be stirred, and a holding member for holding the stirring blade 11 at a desired height in the container 19.

Figure 3:
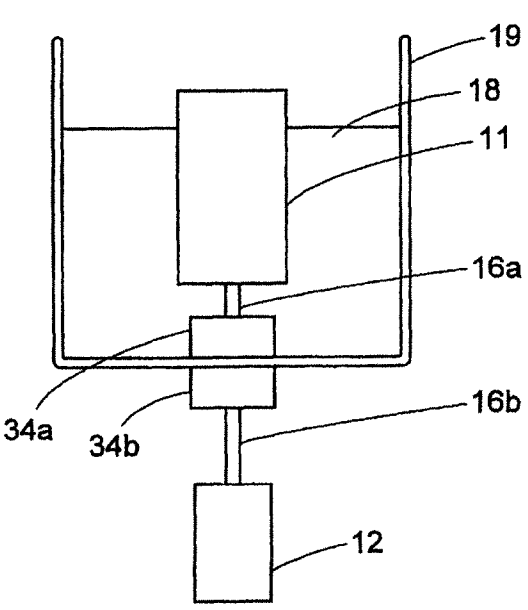
FIG. 3(*a*) is a drawing showing one example of a holding member for holding the stirring blade at a desired height in a container according to one embodiment of the present invention.
Figure 3:
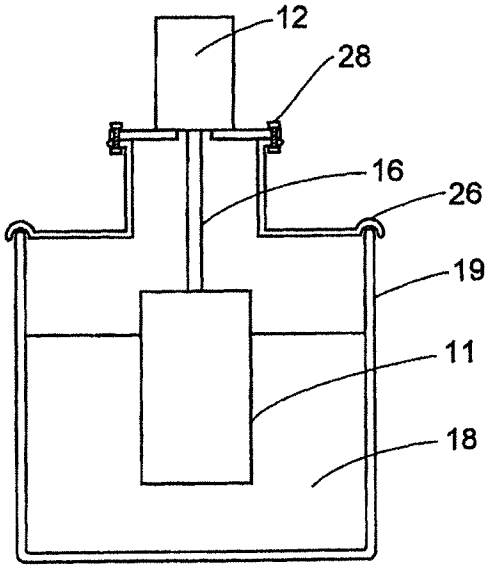

FIG. 3(*a*) and FIG. 3(*b*) show several examples of the holding member for holding the stirring blade 11 at a desired height in the container 19. The holding member may be a member having any structure as long as it can hold the stirring blade 11 at a desired height in the container 19. In one embodiment, the holding member includes, as shown in FIG. 3(*a*), a lid 26 of the container 19, and fixtures 28 such as a bolt and a nut for coupling a flange of the rotational driving device 12 to the periphery of an opening of the lid 26. The shaft 16 extends into the container 19 through the opening of the lid 26, and holds the stirring blade 11 at a desired height in the container 19. In one embodiment, the holding member includes, as shown in FIG. 3(*b*), a magnet 34*a* placed on the bottom of the container 19, and a shaft 16*a*, which is coupled to the magnet 34*a* and the stirring blade 11 to hold the stirring blade 11 at a desired height in the container 19. The magnet 34*a* is coupled across a bottom of the container 19 to a magnet 34*b* with an opposite polarity placed outside the container by a magnetic force, and rotated by the rotational driving device 12 through the magnet 34*b* and a shaft 16*b*.

The container 19 may have any shape within such a range that effects of the invention can produced. In one embodiment, the container 19 has a cylindrical shape. In one embodiment, the container 19 has a shape of a regular polygonal column such as a regular square column, a regular hexagonal column or a regular octagonal column. The container 19 may be formed of any material within such a range that effects of the invention can be produced. In one embodiment, the container 19 is formed of a metal such as aluminum or stainless steel. In one embodiment, the container 19 is formed of a resin such as plastics or acryl.

For the obtainment of an effective stirring ability, the dimension of the first and second flat surfaces A and B and the space therebetween are determined in accordance with the shape and the dimension of the container 19.

As one example, the container 19 may, for example, have a cylindrical shape with a diameter (internal dimension) d and a depth h; and the first and second flat surfaces A and B may, for example, have the same rectangular shape, the same height H in the direction of the rotational axis 17 and the same width W in the direction orthogonal to the rotational axis 17. In this case, the dimension (W, H) of the first and second flat surfaces A and B and the distance $D_1$ therebetween for obtaining an effective stirring ability fall within the following ranges (upper and lower limits).

(i) The width W of the first and second flat surfaces A and B is 20% or more, preferably 25% or more, or more preferably 30% or more of the diameter d of the container 19. Further, the width W of the first and second flat surfaces A and B is 80% or less, preferably 75% or less, or more preferably 70% or less of the diameter d of the container 19.

(ii) The height H of the first and second flat surfaces A and B is 20% or more, preferably 25% or more, or more preferably 30% or more of the depth h of the container 19. Further, the height H of the first and second flat surfaces A and B is 80% or less, preferably 75% or less, or more preferably 70% or less of the depth h of the container 19.

(iii) The first distance $D_1$ between the first and second flat surfaces A and B is 20% or more, preferably 25% or more, or more preferably 30% or more of the width W of the first and second flat surfaces A and B. Further, the first distance $D_1$ between the first and second flat surfaces A and B is 80% or less, preferably 75% or less, or more preferably 70% or less of the width W of the first and second flat surfaces A and B.

As another example, the container 19 may, for example, have a regular square columnar shape having a square horizontal cross section with a length d of one side (internal dimension), and a depth h; and the first and second flat surfaces A and B may, for example, have the same rectangular shape, the same height H in the direction of the rotational axis 17 and the same width W in the direction orthogonal to the rotational axis 17. In this case, the dimension (W, H) of the first and second flat surfaces A and B and the distance $D_1$ therebetween for obtaining an effective stirring ability fall within the following ranges (upper and lower limits).

(i) The width W of the first and second flat surfaces A and B is 20% or more, preferably 25% or more, or more preferably 30% or more of a length d of one side of the square horizontal cross section of the container 19. Further, the width W of the first and second flat surfaces A and B is 80% or less, preferably 75% or less, or more preferably 70% or less of the length d of one side of the square horizontal cross section of the container 19.

(ii) The height H of the first and second flat surfaces A and B is 20% or more, preferably 25% or more, or more preferably 30% or more of the depth h of the container 19. Further, the height H of the first and second flat surfaces A and B is 80% or less, preferably 75% or less, or more preferably 70% or less of the depth h of the container 19.

(iii) The first distance $D_1$ between the first and second flat surfaces A and B is 20% or more, preferably 25% or more, or more preferably 30% or more of the width W of the first and second flat surfaces A and B. Further, the first distance $D_1$ between the first and second flat surfaces A and B is 80% or less, preferably 75% or less, or more preferably 70% or less of the width W of the first and second flat surfaces A and B.

Figure 4:
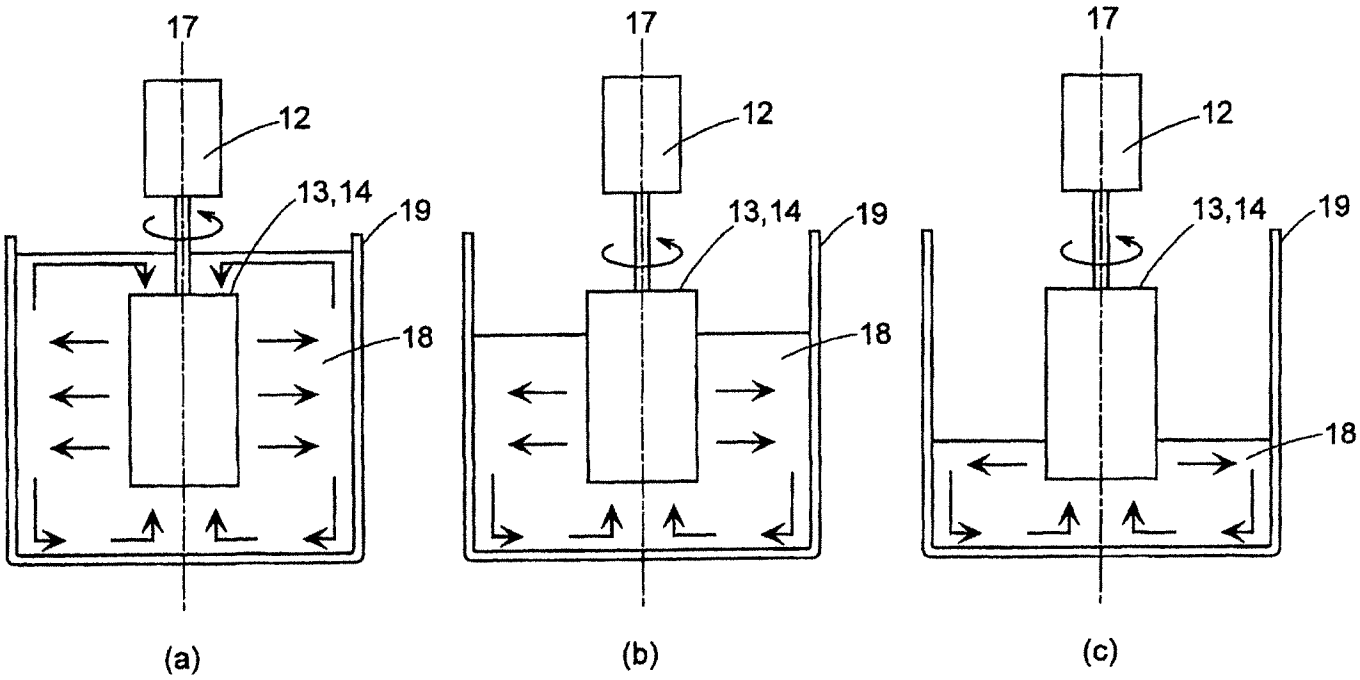
FIG. 4(*a*) to FIG. 4(*c*) are drawings where arrows indicate convection currents generated in the object to be stirred by the stirring blade according to one embodiment of the present invention when the liquid level of the object to be stirred is varied in many ways.

FIG. 4(*a*) to FIG. 4(*c*) are drawings wherein arrows indicate convection currents generated in the object 18 to be stirred by the stirring blade 11 when the height of the liquid level of the object 18 to be stirred is varied in many ways. The stirring blade 11 of the present invention has a vertically long stirring plate (that is, the first and second members 13 and 14) produced in accordance with the depth of the container 19; in other words, it may be a long and narrow member extending in the direction of the rotational axis 17; and thus, convection currents can be generated in the object 18 to be stirred even when the height of the liquid surface is varied in many ways as shown in FIG. 4(*a*) to FIG. 4(*c*), thereby enabling effective stirring of the object 18 to be stirred.

Figure 5:
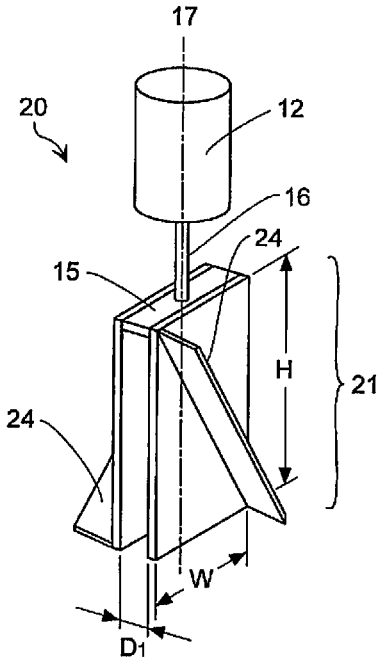
FIG. 5 is a perspective view showing a stirring apparatus 20 having a stirring blade 21 according to another embodiment of the present invention.

FIG. 5 is a perspective view showing a stirring apparatus 20 having a stirring blade 21 according to another embodiment of the present invention. The stirring apparatus 20 has the same configuration as the stirring apparatus 10 shown in FIG. 1(*a*) except that each of the first member 13 and the second member 14 further has a paddle blade 24 on an outside surface from a radius of rotation. Same signs are given to the same members as in FIG. 1 and explanation is omitted on the same constituent elements as those of the stirring apparatus 10 shown in FIG. 1(*a*). The paddle blade 24 promotes vertical convection currents in the object 18 to be stirred (sucking or blowing out, which is determined depending on the rotational direction), and has an effect of enhancing the stirring efficiency.

The paddle blade 24 may be formed of any material within such a range that effects of the invention can be produced. In one embodiment, the paddle blade 24 is formed of a metal such as aluminum or stainless steel. In one embodiment, the paddle blade 24 is formed of a resin such as plastics or acryl. In one embodiment, the paddle blade 24 may be produced separately from the first member 13 or the second member 14 and coupled thereto by welding or an adhesive. In one embodiment, the paddle blade 24 may be formed integrally with the first member 13 or the second member 14 by molding such as injection molding or extrusion molding.

Figure 6:
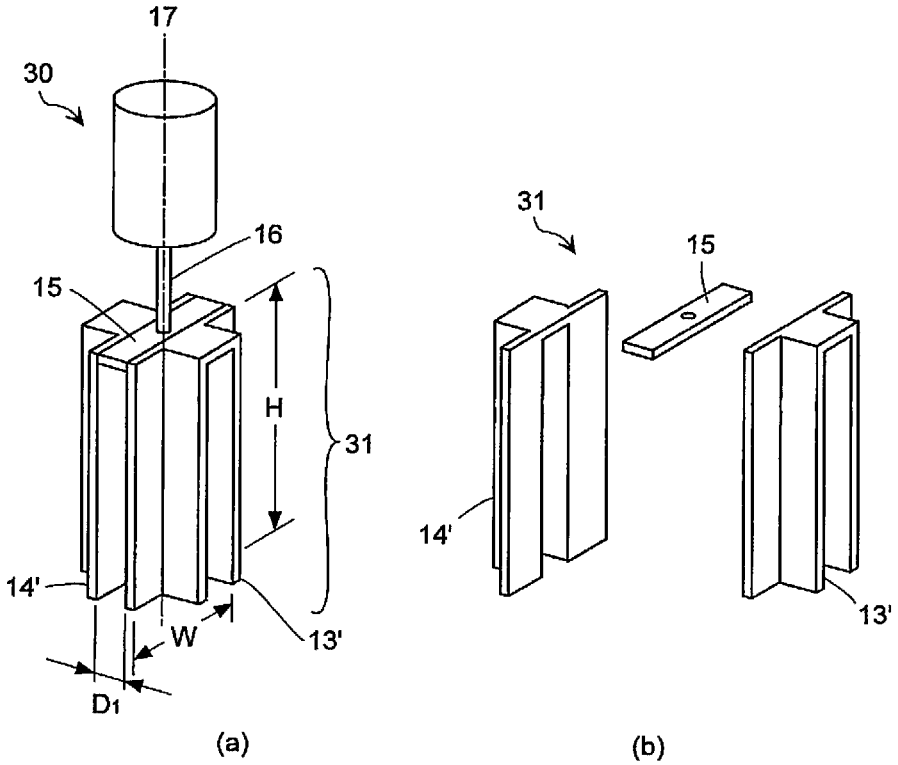
FIG. 6(*a*) is a perspective view showing a stirring apparatus 30 having a stirring blade 31 according to still another embodiment of the present invention.
Figure 7:
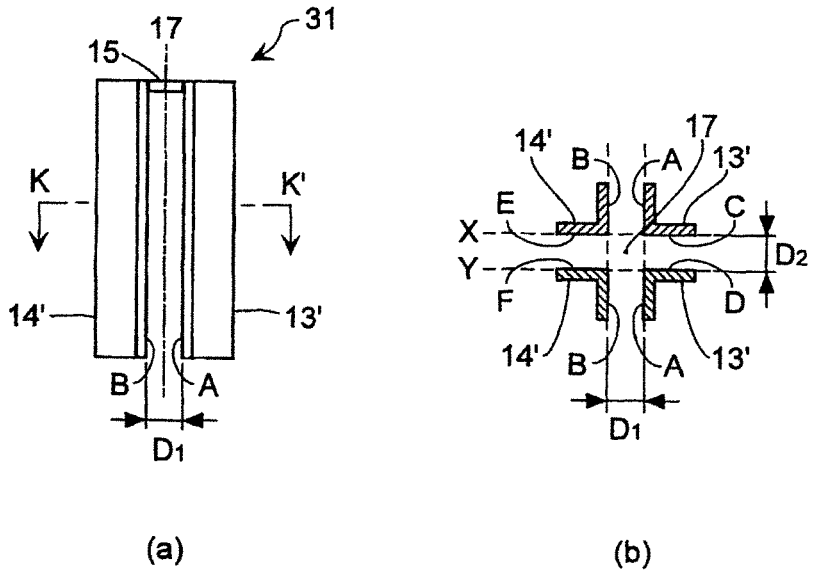
FIG. 7(*a*) is a front view of the stirring blade 31 of the stirring apparatus 30 shown in FIG. 6(*a*).

FIG. 6(*a*) is a perspective view showing a stirring apparatus 30 having a stirring blade 31 according to still another embodiment of the present invention. FIG. 6(*b*) is an exploded perspective view of the stirring blade 31. FIG. 7(*a*) is a front view of the stirring blade 11, and FIG. 7(*b*) is a cross-sectional view taken along line K-K' of the stirring blade 11. As shown in FIG. 7(*b*), in the stirring apparatus 30, a first member 13' further has a third flat surface C and a fourth flat surface D vertical to a first flat surface A. The third flat surface C and the fourth flat surface D are disposed to oppose each other and be spaced by a second distance $D_2$. The space between the third flat surface C and the fourth flat surface D is open in a direction vertical to the first flat surface A. The space between the third flat surface D and the fourth flat surface D is also open in a direction along the rotational axis 17 (downward direction in the example of FIG. 6(*a*)). In addition, a second member 14' further has a fifth flat surface E and a sixth flat surface F vertical to the second flat surface B. The fifth flat surface E and the six flat surface F are disposed to oppose each other and be spaced by the second distance $D_2$. The space between the fifth flat surface E and the sixth flat surface F is open in a direction vertical to the second flat surface B. The space between the fifth flat surface E and the sixth flat surface F is also open in a direction along the rotational axis 17 (downward direction in the example of FIG. 6(*a*)). The first distance $D_1$ and the second distance $D_2$ may be equal to or different from each other.

As shown in FIG. 7(*b*), in one embodiment, the third flat surface C and the fifth flat surface E are disposed on a virtual flat surface X; the fourth flat surface D and the sixth flat surface F are disposed on a virtual flat surface Y; and the rotational axis 17 is disposed between the virtual flat surface X and the virtual flat surface Y. In one embodiment, the rotational axis 17 is disposed between the virtual flat surfaces X and Y so as to be equidistant from the virtual flat surfaces X and Y. However, the position of the rotational axis 17 may not always be at the geometrical center; and it may be slightly displaced from the geometrical center within such a range that effects of the invention can be produced.

Regarding other points, the stirring apparatus 30 has the same configuration as the stirring apparatus 10 shown in FIG. 1(*a*). Same or similar signs are given to the same members as in FIG. 1(*a*) and explanation is omitted on the same constituent elements as those of the stirring apparatus 10 shown in FIG. 1(*a*).

Figure 8:
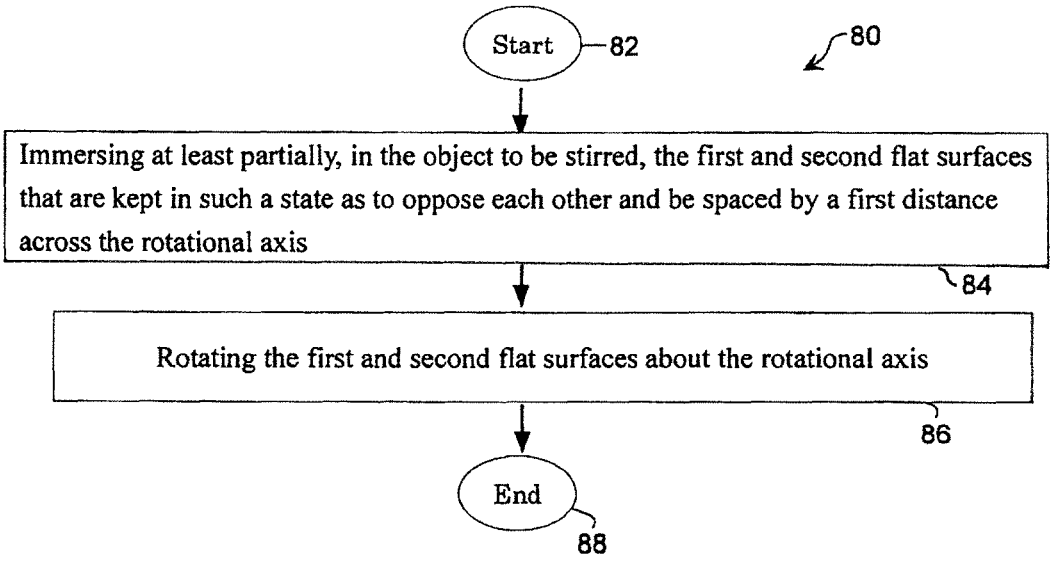
FIG. 8 is a flow diagram showing a method for stirring an object to be stirred according to one embodiment of the present invention.

FIG. 8 shows a method 80 for stirring an object to be stirred. The method 80 starts with step 82, and proceeds to step 84, where the first and second flat surfaces that are kept in such a state as to oppose each other and be spaced by a first distance across the rotational axis are first immersed at least partially in the object to be stirred. Next, the method proceeds to step 86 where the first and second flat surfaces are rotated about the rotational axis. Step 86 may further include: discharging the object to be stirred having entered between the first and second flat surfaces in a direction away from the rotational axis by a centrifugal force and, simultaneously, sucking the object to be stirred into and between the first and second flat surfaces from a direction along the rotational axis. Thereafter, the method proceeds to step 88, where the method 80 ends.

Figure 9:
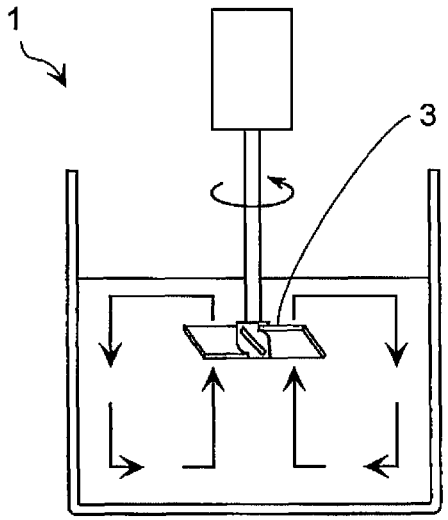
FIG. 9 is a drawing showing one example of a stirring apparatus having a conventional paddle blade.

According to the present invention, since the stirring blade has a simple structure, the stirring blade and the stirring apparatus can be produced at a low cost; and the stirring blade can also be washed easily. Further, according to the present invention, the area of the stirring blade can be increased depending on the shape or the dimension of the container, and the object to be stirred can be stirred effectively even at a low rotational speed; and thus, biomaterials such as microorganisms or cells of living organisms can be gently stirred while shearing or destruction thereof is kept at the minimum level. This can be intuitively understood by comparing the parallel stirring blades 13, 14 of the stirring apparatus according to the present invention shown in FIG. 2 with the paddle blade 3 of the conventional stirring apparatus 1 as shown in FIG. 9. Further, according to the present invention, the stirring blade may have a long and narrow shape in accordance with the shape or the dimension of the container; and thus, even when the liquid level of the object to be stirred is varied in many ways, the object to be stirred can be effectively stirred. Furthermore, according to the present invention, since the rotational speed of the stirring blade can be kept at a lower level, the speed reducing ratio of the motor can be increased and the stirring blade can be rotated with a high torque.

The above description on various embodiments of the present invention has a purpose for exemplification and does not limit the scope of the invention. The scope of the present invention is defined by the scope of the claims.

REFERENCE SIGNS LIST

A First flat surface
B Second flat surface
10, 20, 30 Stirring apparatus
11, 21, 31 Stirring blade
12 Rotational driving device
13, 13' First member
14, 14' Second member
15 Support member
17 Rotational axis

The invention claimed is:

1. A stirring blade comprising a first member having a first flat surface and a second member having a second flat surface, wherein the stirring blade is rotatable about a rotational axis in a state where the first flat surface and the second flat surface are opposed to each other and are spaced by a first distance across the rotational axis, the space between the first flat surface of the first member and the second flat surface of the second member being open outwardly in a direction orthogonal to the rotational axis, the stirring blade, when rotated about the rotational axis with the first flat surface and the second flat surface at least partially immersed in an object to be stirred, configured to discharge the object to be stirred disposed between the first and second flat surfaces in a direction away from the rotational axis and orthogonal to the rotational axis by a centrifugal force and, simultaneously, suck the object to be stirred into and between the first and second flat surfaces from a direction along the rotational axis, the first member further having a third flat surface and a fourth flat surface perpendicular to the first flat surface, the third and fourth flat surfaces disposed to oppose each other and spaced by a second distance, the second member further having a fifth flat surface and a sixth flat surface perpendicular to the second flat surface, the fifth and sixth flat surfaces disposed to oppose each other and spaced by the second distance, and a support member disposed between a top end of the first member and a top end of the second member for connecting the first member to the second member, wherein:

the space between the third flat surface and the fourth flat surface is open inwardly in the direction orthogonal to the rotational axis toward the space between the first flat surface and the second flat surface, and the space between the fifth flat surface and the sixth flat surface is open inwardly in the direction orthogonal to the rotational axis toward the space between the first flat surface and the second flat surface, the space between the third flat surface and the fourth flat surface is open outwardly in the direction orthogonal to the rotational axis, and the space between the fifth flat surface and the sixth flat surface is open outwardly in the direction orthogonal to the rotational axis, and the space between the first flat surface and the second flat surface, the space between the third flat surface and the fourth flat surface, and the space between the fifth flat surface and the sixth flat surface are open downwardly in the direction along the rotational axis.

* * * * *